US006227116B1

(12) United States Patent
Dumenko

(10) Patent No.: US 6,227,116 B1
(45) Date of Patent: May 8, 2001

(54) PYROTECHNICAL CHARGE FOR DETONATORS

(75) Inventor: Viktor Dumenko, Gyttorp (SE)

(73) Assignee: Nitro Nobel AB (SE)

( * ) Notice: Subject to any disclaimer, the term of this patent is extended or adjusted under 35 U.S.C. 154(b) by 0 days.

(21) Appl. No.: 09/091,342

(22) PCT Filed: Dec. 12, 1996

(86) PCT No.: PCT/SE96/01646

§ 371 Date: Jul. 10, 1998

§ 102(e) Date: Jul. 10, 1998

(87) PCT Pub. No.: WO97/22571

PCT Pub. Date: Jun. 26, 1997

(30) Foreign Application Priority Data

Dec. 20, 1995 (SE) ..... 9504571

(51) Int. Cl.[7] ..... C06C 5/00; C06C 5/06; C06B 33/00; D03D 23/00

(52) U.S. Cl. ..... 102/275.3; 102/275.6; 102/275.11; 149/37; 149/108.6

(58) Field of Search ..... 149/37, 38, 108.6; 102/202.5, 202.7, 202.8, 202.13, 202.14, 205, 204, 275.3, 277.1, 275.6, 275.11

(56) References Cited

U.S. PATENT DOCUMENTS

| | | | | |
|---|---|---|---|---|
| 2,185,371 | | 1/1940 | Burrows et al. | 52/15 |
| 3,062,143 | * | 11/1962 | Savitt et al. | 102/28 |
| 3,212,439 | | 10/1965 | Reyne | 102/28 |
| 3,817,181 | * | 6/1974 | Persson et al. | 102/29 |
| 3,890,174 | | 6/1975 | Helms, Jr. et al. | 149/44 |
| 3,978,791 | | 9/1976 | Lemley et al. | 102/28 |
| 4,144,814 | | 3/1979 | Day et al. | 102/28 |
| 4,239,004 | | 12/1980 | Day et al. | 102/28 |
| 4,352,397 | * | 10/1982 | Christopher | 166/297 |
| 4,419,145 | * | 12/1983 | Davitt et al. | 149/40 |
| 4,541,342 | * | 9/1985 | Routledge | 102/308 |
| 4,727,808 | | 3/1988 | Wang et al. | 102/202.5 |
| 4,756,250 | * | 7/1988 | Dias Dos Santos | 102/275.1 |
| 5,088,412 | * | 2/1992 | Patrichi | 102/202.13 |
| 5,147,476 | * | 9/1992 | Beck et al. | 149/37 |
| 5,385,098 | | 1/1995 | Lindqvist et al. | 102/205 |
| 5,585,594 | * | 12/1996 | Pelham et al. | 102/336 |
| 5,654,520 | * | 8/1997 | Boberg et al. | 102/205 |

FOREIGN PATENT DOCUMENTS

| | | |
|---|---|---|
| 2413093 | 10/1974 | (DE) . |
| 25 30 209 | 1/1976 | (DE) . |
| 0310580 | 4/1989 | (EP) . |
| 2242899 | 4/1971 | (FR) . |
| 760360 | 10/1956 | (GB) . |
| 2146014 | 4/1985 | (GB) . |
| WO90/07689 | 7/1990 | (WO) . |

OTHER PUBLICATIONS

A.A. Shidlovskii, Fundamentals of Pyrotechnics, Moscow, Mashinostroenie, 1973, p. 274.

* cited by examiner

*Primary Examiner*—Charles T. Jordan
*Assistant Examiner*—Aileen J. Baker
(74) *Attorney, Agent, or Firm*—Burns Doane Swecker & Mathis LLP

(57) ABSTRACT

A detonator comprising a shell with a secondary explosive base charge, igniting means and an intermediate pyrotechnical train, said train comprising a novel ignition composition with a specific redox-pair of a metal fuel and a metal oxide oxidant, said fuel being present in excess to the amount of stoichiometrically being required to reduce the metal oxide, the ignition composition being able to ignite said secondary explosive into a convective deflagrating state to reliably detonate the same. Use of said novel ignition composition for the ignition of secondary explosives in general.

39 Claims, 1 Drawing Sheet

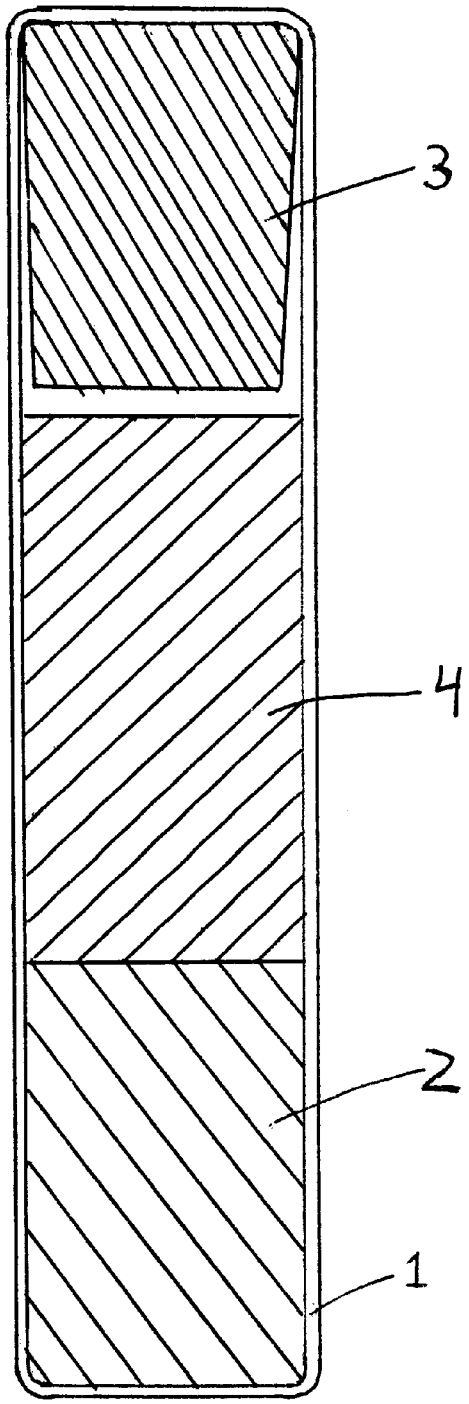
FIGURE

PYROTECHNICAL CHARGE FOR DETONATORS

TECHNICAL FIELD

The present invention relates to the art of detonators of the kind comprising a shell with a base charge comprising secondary explosive arranged at one end of said shell, igniting means arranged at the opposite end thereof and an intermediate part with a pyrotechnical train being able to convert an ignition pulse from the igniting means to a detonation of the base charge. More specifically the invention relates to novel compositions of pyrotechnical charges to be used as ignition charges in such detonators and for the ignition of secondary explosives in general.

BACKGROUND OF THE INVENTION

Detonators are used for various purposes, both military and civilian ones, but will here be described mainly in relation to applications for commercial rock blasting where typically a plurality of detonators from an assortment with different internal time delays are connected in a network of electric or non-electric signal conductors.

In such detonators pyrotechnical charges may be used for different purposes in a pyrotechnical train converting an ignition pulse from igniting or signaling means to a detonation in a base charge, e.g. as a rapid transfer or amplifying charge, a slower delay charge, a gas-impermeable sealing charge or an ignition charge for detonating said base charge.

One example of a pyrotechnical charge in a pyrotechnical train is given in U.S. Pat. No. 2,185,371, which discloses a delay charge with an alloy of antimony as a specific fuel. Other examples are given in GB-A-2 146 014 and DE-A-2 413 093, which disclose a pyrotechnic fuel composition for severing conduits and an explosive mixture, respectively. As an example of a method of producing pyrotechnical charges reference is made to EP 0 310 580, which discloses the production of delay and ignition charges.

Common to all this prior art is, however, that it does not disclose or even suggest the use of our specific ignition charge to quantitatively and reliably detonate secondary explosive charges.

Ever increasing demands are placed on all the parts of the pyrotechnical train. A main requirement is that the charges shall burn with well defined and stable reaction rates with limited time scatter. The burning rate must not be significantly influenced by ambient conditions or ageing. The charges shall have reproducible ignition properties but yet be insensitive to shock, vibrations, friction and electric discharges. The nominal burning rate should be adjustable with minor charge modifications. The charge mixture has to be easy and safe to prepare, dose and press and not too sensitive to production conditions. In addition thereto there is a growing requirement that the charges must not contain toxic substances and that preparations can be made without health hazardous conditions such as use of solvents.

Although pyrotechnical charges in general can be regarded as mixtures of a fuel and an oxidant, and accordingly many compositions should be potentially available, the above described requirements together significantly limit the choice of suitable compositions for each of said charges. A need exists, however, for further improvements, both in respect of performance and because hitherto established compounds for the purpose, such as lead or cromate compounds, are becoming less available and accepted.

GENERAL DESCRIPTION OF THE INVENTION

The main object of the present invention is to provide a detonator, and pyrotechnical charges useful therein, with improved performance and properties in the above mentioned respects.

A more specific object is to provide a detonator with a pyrotechnical train having the capability of igniting a secondary explosive in a qualitative and reliable way.

Another object is to provide a detonator with stable properties in respect of burning rate, ageing and environmental influence in manufacture, storing and use.

A further object is to provide such a detonator with reliable properties but yet safe against unintentional initiation.

Another object is to provide such a detonator with less health hazardous components.

Yet another object is to provide such a detonator allowing safe and environmentally harmless conditions.

Still another object is to provide use of a pyrotechnical charge for ignition of secondary explosives in general and even without any primary explosive being present in connection therewith.

These objects are reached by the characteristics set forth in the appended claims.

Thus, according to the invention it has unexpectedly been found that a specific combination of metal fuel and metal oxide oxidant possesses the ability of quantitatively and reliably igniting secondary explosives, especially in detonators of the type specified in the opening part of this specification, and even in a case where there is no primary explosive present.

In this context qualitative ignition or similar means an ignition of a secondary explosive not with any laminar combustion where the burning front is flat but with a convective burning stage where the burning is extremely non-homogenous.

A very important finding in connection therewith is that in spite of said combustion or burning mechanism a very reliable ignition of the secondary explosive has been obtained, the remaining functions of the pyrotechnical train not being negatively influenced upon.

Furthermore, the qualitative ignition accomplished allows for a considerable shortening of the detonation development (time from deflagration to detonation) of the detonator, which in turn enables a considerable reduction of the length of the pyrotechnical train, or the initiation element, and/or a reduction of the strength or thickness of the shell, without any impairment of the function of the detonator.

Without being restricted to any theory as to reaction mechanisms, the invention seems to be based on the generation, by the novel ignition charge, of extremely hot gases with a high thermal capacity and under high pressure. Probably the igniting gases essentially consist of vapours from the metals present in the ignition charge. Only these properties seem to secure a qualitative ignition of a secondary explosive.

More specifically the invention relates to a detonator comprising secondary explosive at one end thereof, igniting means arranged at the opposite end thereof and an intermediate pyrotechnical train converting an ignition pulse from the igniting means to the base charge to detonate the same, the pyrotechnical train comprising an ignition charge comprising a metal fuel selected from groups 2, 4 and 13 of the periodic table and an oxidant in the form of an oxide of a metal selected from periods 4 and 6 of the periodic table, the metal fuel being present in an excess relative to the amount stoichiometrically necessary to reduce the amount of metal oxide oxidant, said ignition charge generating a hot pressurized gas that is able to ignite said secondary explosive of the base charge into a convective deflagrating state to reliably detonate the same.

Thus, by use of the defined ignition charge, which generally reacts by "inversion" of the metal/oxide system under heat generation, and which can be considered a thermite charge, the abovesaid objectives are met. Metal is present before, during and after reaction, securing high electric and heat conductivities. Electric conductivity means reduced risks for unintentional ignition through static electricity or other electrical disturbances. High heat conductivity means low risks for unintentional ignition through local overheating through friction, impact or otherwise, while good ignition properties from the reacted charge are secured by high and sustained heat transfer. Presence of molten metal in the reaction products amplifies the latter properties. Metal oxides are generally stable products also in the presence of water and so are the metals, often through surface passivation, which gives good ageing properties and allows for charge preparation in water suspensions, and which perhaps also explains observed reaction rate invariability in presence of moisture. The reactants of the thermite charge are generally non-toxic and environmentally harmless. A further valuable features of the thermite charge used is that it reacts under substantial heat generation, as was said above, which contributes not only to good ignition properties but more importantly to limited reaction time scatter, partly due to reaction independence of initial temperature conditions.

In detonator design applications it is especially beneficial that charges can be used for different purposes and satisfy several demands simultaneously. The charges used as ignition charges according to the invention can be used as rapid burning transfer charges, utilizing the reaction property of forming generous gaseous intermediates, giving high ignition and reaction speeds in porous charges. The charges can be used for pyrotechnical delays, utilizing the charge stability under different conditions, stable burning rates and burning rate variability by the addition of inert additives. The charges can be used as sealer charges for control of gas penetration, utilizing the excellent slag forming properties of the molten metal reaction product, which can easily be further improved on by addition of reinforcing or filler materials. Finally, in accordance with the invention the charges can also be used as igniter charges for secondary pyrotechnicals, mainly in non-primary explosive type detonators, utilizing the full range of composition potent initiation capabilities, including high temperatures and back-sealing, to establish the very fast and reliable ignition front needed for this detonation mechanism.

Further objects and advantages of the invention will be evident from the detailed description herein below.

BRIEF DESCRIPTION OF THE DRAWING

The FIGURE illustrates a detonator according to the invention.

DETAILED DESCRIPTION OF THE INVENTION

The drawing provides a general illustration of a detonator according to the present invention. The detonator comprises a shell 1 with a base charge 2 comprising secondary explosive at one end thereof. An ignition means 3 is arranged at the opposite end of the shell 1. The shell 1 also contains an intermediate part with a pyrotechnical train 4 comprising an ignition charge being able to convert an ignition pulse from the ignition means 3 to a detonation of the base charge 2.

Many pyrotechnical compositions contain a redox-pair in which a reductant and an oxidant are able to react under heat generation. Characteristic of the present invention is, however, that the reductant, or fuel, is a metal, that the oxidant is a metal oxide and that the redox-pair is a thermite pair which is able to react under oxidation of the original metal fuel and reduction to metal of the original metal oxide oxidant.

The heat generated during the reaction should be sufficient to leave at least a part and preferably all of the metal end product in molten form. The heat need not be sufficient to melt any other components added to the system such as inert fillers, surplus of reactants or components of other reactive pyrotechnical systems. In essence, in the reaction the original metal fuel replaces the metal of the oxide, which can be described as an "inversion" of the metal/oxide system. For this to happen the metal fuel shall have a higher affinity for the oxygen than the metal of the oxide. A precise condition therefor is difficult to give but as a general indication, in the electrochemical series, considering reactions corresponding to the actual valence change into the elemental metal, the metal fuel should be at least 0.5, better, preferably at least 0.75 and more preferably at least 1 volt more electronegative than the metal of the metal oxide.

In accordance with the invention the metal fuel is, thus, selected from groups 2, 4 and 13 of the periodic table. In this context it should be noted that the groups and periods (cf. below) referred to in the periodic table are those groups and periods which are defined by the periodic table presented below.

Periodic table used

| | 1 | 2 | 3 | 4 | 5 | 6 | 7 | 8 | 9 | 10 | 11 | 12 | 13 | 14 | 15 | 16 | 17 | 0 |
|---|---|---|---|---|---|---|---|---|---|---|---|---|---|---|---|---|---|---|
| 1 | H | | | | | | | | | | | | | | | | | He |
| 2 | Li | Be | | | | | | | | | | | B | C | N | O | F | Ne |
| 3 | Na | Mg | | | | | | | | | | | Al | Si | P | S | Cl | Ar |
| 4 | K | Ca | Sc | Ti | V | Cr | Mn | Fe | Co | Ni | Cu | Zn | Ga | Ge | As | Se | Br | Kr |
| 5 | Rb | Sr | Y | Zr | Nb | Mo | Tc | Ru | Rh | Pd | Ag | Cd | In | Sn | Sb | Te | I | Xe |
| 6 | Cs | Ba | La | Hf | Ta | W | Re | Os | Ir | Pt | Au | Hg | Tl | Pb | Bi | Po | At | Rn |
| 7 | Fr | Ra | Ac | | | | | | | | | | | | | | | |

non-metals half-metals metals

In other words group 2, from which the metal fuel is selected, contains inter alia the metals Be, Mg, Ca, Sr and Ba, while group 4 contains the metals Ti, Zr and Hf, and group 13 contains Al, Ga, In and Tl.

Preferably, however, the metal fuel is selected from periods 3 and 4 of said groups 2, 4 and 13, which means Mg, Al, Ca, Ti and Ge. More preferably said fuel is selected from the metals Al and Ti.

The metal of the metal oxide oxidant is, as was said above, selected from periods 4 and 6 of the periodic table, period 4 containing K, Ca, Sc, Ti, V, Cr, Mn, Fe, Co, Ni, Cu and Zn, and period 6 containing Cs, Ba, La, Hf, Ta, W, Re, Os, Ir, Pt, Au, Hg, Tl, Pb, Bi and Po.

Preferable metals of said period 4 are, however, Cr, Mn, Fe, Ni, Cu and Zn, and especially preferable ones are Mn, Fe and Cu.

Preferable metals of said period 6 are Ba, W and Bi, and an especially preferable one is Bi.

In this context especially preferably oxides are $Fe_2O_3$, $Fe_3O_4$, $Cu_2O$, CuO, $Bi_2O_3$ and $MnO_2$.

As indicated, the ignition charges according to the invention are thermite charges which are able to produce very high combustion temperatures. As a measure of the combustion temperature there may be used the theoretically calculated end temperature in a reaction to final equilibrium between present reactants in a mechanically and thermally isolated system under the density and concentration conditions actually present in the charge considered. This measure is independent of charge burning rate, gas permeability and isolation and will be referred to below as "ideal" charge burning temperature. The ideal burning temperature may serve as an approximation for the actual burning temperature for charges with fast burning rate, little gas permeability, large physical dimensions or otherwise small losses to the surroundings. For charges which cannot be said to approximately satisfy the last-mentioned conditions an "actual" burning temperature should be determined through measurements. This can be done for example by insertion of a thermocouple in the charge, by registration of emission spectra from the charge when reacted in a transparent material or from an optical fibre positioned in the charge or in any other way. When charge combustion temperature is a factor, as will be further discussed below, the ideal burning temperature should exceed 2000 degrees Kelvin, preferably exceed 2300 degrees and most preferably exceed 2600 degrees Kelvin. Charge composition and geometry should preferably be designed to give actual burning temperatures exceeding 60, preferably exceeding 70 and most preferably exceeding 80, percent of the ideal burning temperature expressed in degrees Kelvin.

Pyrotechnical charges for detonators are essentially confined therein and it is a general requirement that the overall reaction is substantially gas-less in order not to disrupt detonator structures. The present compositions, being composed of a metal and metal oxide pair both as reactants and products, excellently satisfy the gas-less condition for overall reaction.

As was stated above, however, it is believed that the good burning characteristics and igniting properties of the compositions are essentially due to the formation of gaseous intermediates not present in other similar compositions. At least in part due to high reaction temperatures in combination with fairly low boiling points of the metal fuels meeting the abovesaid conditions are believed to generate temporary vapour intermediates of the metal fuel.

This effect can be amplified by the addition of another easily vaporizable component although the preferred way for this purpose is to use a surplus of the metal fuel, which composition type will also be referred to as a "gas-enhanced" composition. Too large amounts will cool the composition and counteract gas formation. Accordingly, in such compositions the amount of metal fuel generally is more than 1 and less than 12 times the amount stoichiometrically necessary to reduce the amount of metal oxide oxidant, the upper limit more preferably being 6 times, and most preferably being 4 times, said stoichiometrically required amount. According to another preferable embodiment of the invention the amount of metal fuel is between 1.1 and 6 times said amount and more preferably the amount of metal fuel is between 1.5 and 4 times said amount.

Expressed as percentages, based on the total weight of the ignition charge composition, the metal fuel is generally present in an amount of 10–50% by weight, preferably 15–35% by weight and more preferably 15–25% by weight. Thus, the corresponding percentages of metal oxide oxidant are 90–50% by weight, preferably 85–65% by weight and more preferably 75–65% by weight.

According to one preferable embodiment of the invention the metal fuel is Al and the metal oxide oxidant is $Cu_2O$ or $Bi_1O_3$, the percentage of said fuel being 15–35% by weight and the percentage of said oxidant being 65–85% by weight.

According to another preferably embodiment of the invention the metal fuel is Ti and the metal oxide oxidant is $Bi_2O_3$, the percentage of fuel being 15–25% by weight, preferably around 20% by weight, and the percentage of oxidant being 75–85% by weight, preferably around 80% by weight.

For several reasons it may be desirable to incorporate a more or less inert, or even active, solid component in the composition, e.g. to influence upon the burning rate of the composition, to reduce the sensitivity of the composition to electrostatic sparks or to affect slag properties. Use of an inert solid component which is a compound that is also a product of the reaction is beneficial not to alter the system properties and not to reduce the above said formation of vapour intermediates. Addition of a metal oxide is, however, preferred, e.g. to reduce reaction speed without too much cooling. Said metal oxide may be an end product of the actual system used, but it is possible also to add another metal oxide, e.g. an end product from another inversion system as defined above. Especially preferred oxides in this respect are oxides of Al, Si, Fe, Zn, Ti or mixtures thereof. The inert solid component can also be a particulate metal, among other things contributing to strong slags. Such compositions will hereinafter also be referred to as "metal-reinforced". The end product metal may be used as such an additive in the metal-reinforced compositions. The end product metal produced in the reaction is normally in melted form and said addition can for example give a mixture of molten and unmolten metal, suitable for formation of both strong and impermeable slags.

A better control compared to this partial melting is obtained if the metal is solid at the reaction temperature of the charge, e.g. by the addition of a solid metal other than an end product and having a higher melting temperature. Although any such metal can be used especially useful metals comprise Ti, Ni, Mn and W or mixtures or alloys thereof and in particular W or a mixture or alloy of W with Fe.

The metals and/or metal oxides referred to above are generally used in an amount of 2–30% by weight, preferably 4–20% by weight and more preferably 5–15% by weight, such as 6–10% by weight, said percentages being based on the weight of the pyrotechnical charge(s), especially the ignition charge.

As is common practice other additives than pyrotechnical additives can also be incorporated in the mixtures, e.g. in order to improve the free-flowing or pressability properties or binder additives to improve cohesion or allow granulation, for example clay materials or carboxy methyl cellulose. Additives for these latter purposes are generally used in small amounts, especially if the additives generate permanent gases, e.g. below 4% by weight, preferably below 2% and often even below 1% by weight, based on the weight of the pyrotechnical charge(s), especially the ignition charge.

Preferably the ignition charge and any other pyrotechnical charges are in a normal manner composed of powder mixtures. Particle size can be used to influence burning speed and generally it can be between 0.01 and 100 microns and especially between 0.1 and 10 microns. With preference the powders can be granulated to facilitate dosing and pressing, e.g. to a size between 0.1 and 2 mm or preferably between 0.2 and 0.8 mm. Preferably granules are formed from a mixture of at least the redox-pair components.

Although the compositions are relatively insensitive to unintended initiation in a dry state, it is preferred to mix and prepare the compositions in a liquid phase, preferably an aqueous medium or essentially pure water. The mixture can be granulated from the liquid phase by conventional means.

The ignition charge burning speed can be varied within wide limits but generally it varies between 0.001 and 50 m/sec, especially between 0.005 and 10 m/sec. Burning speeds above 50 and in particular above 100 m/sec normally entail charge conditions unsuitable or atypical for detonator applications. As above indicated the burning speed can be affected in several ways, viz. by selection of redox-system, stoichiometric balance between reactants, use of inert additives, charge particle sizes and pressing density.

No general limits can be set for the pressing density as the charges can be used from entirely uncompacted form up to highly pressed. To qualify as charges for the present purposes, however, sufficient composition amounts should be used to allow pressing, i.e. in all three charge dimensions the extension should be several times and preferably multiple times larger than particle sizes, in case of granulated material in relation to at least the primary particles of the granules.

As initially mentioned, the above described ignition charges can be generally used for pyrotechnical purposes to ignite secondary explosives but they are of particular value in detonators, mainly for commercial blasting applications. As was mentioned above such a detonator comprises a shell with a base charge comprising or consisting of secondary explosive arranged at one end, igniting means arranged at the opposite end and an intermediate part or section with a pyrotechnical train having the ability of converting an ignition pulse from the igniting means to a detonation of the base charge.

The igniting means can be of any known kind, such as an electrically initiated fuse head, safety fuse, mild detonating cord, low energy shock tube (e.g. NONEL, registered trademark), exploding wire or film, laser pulses delivered through for example fibre optics, electronic devices, etc. For ignition of the present charges heat-generating igniting means are preferred.

The pyrotechnical train may include a delay charge, typically in the form of a column housed in a substantially cylindrical element. The train may also include transfer charges to amplify burning or assist in ignition of sluggish charges and may further include sealing charges for control of gas permeability. A final part of the train is a step transforming the mainly heat-generating burning in the pyrotechnical charges into shock and detonation of the base charge.

Conventionally this has been done by the incorporation of a small amount of primary explosive next to the secondary explosive to be detonated. Primary explosives detonate rapidly and reliably when subjected to heat or mild shock. However, recent developments have made it possible to design a commercial non-primary explosive type detonator (hereinafter "NPED") in which the primary explosive is replaced with some kind of mechanism, to be further discussed below, for direct generation of detonation in a secondary explosive.

The compositions described above can also be used as rapid transfer charges to pick up and amplify weak burning pulses or to assist in ignition of more sluggish compositions. The compositions are suitable for this purpose thanks to high burning rates and low time scatter, small pressure dependence, ease of initiation, insensitivity to unintended initiation and ignition capability versus other charges. Preferably the composition is gas-enhanced as defined. It is preferred that in the pyrotechnical chain said charge constitutes or is part of a transfer charge arranged at the igniting means for transfer of the ignition pulse from the igniting means to subsequent parts of the pyrotechnical train. To keep up reaction speed and ignition sensitivity charge porosity should be high and pressing density low. Preferably the charge density corresponds to a press force below 100 MPa and more preferably below 10 MPa and substantially unpressed charges can be used. With preference the charge contains granulated material and is pressed with a force sufficient to give maximal porosity in the charge.

In this context the charge burning speed can be above 0.1 and is preferably above 1 m/sec. Only small charges are needed for this purpose and preferably the charge amount is sufficiently small to give a delay time in said transfer charge of less than 1 msec and preferably less than 0.5 msec.

Normally and preferably there is no further charge at the igniting means, but the transfer charge, or an inert enclosure therefor, is directly facing the igniting means. An air gap may be present between the charge and igniting means able to bridge the gap, such as fuse heads or shock tube, which facilitates manufacture. The ignition picking up the ignition pulse. In the latter case a special advantage can be achieved in combination with electric igniting means since the electrically conductive nature of the present compositions makes direct ignition possible from spark, fuse bridge or conduction through the charge itself, securing the ignition process or allowing use of simple igniting means such as a electric gap without a fuse bead.

The other end of the transfer charge may face any other charge in the pyrotechnical chain, most commonly a delay charge, possibly via another charge.

A charge containing the compositions described above may also constitute or be part of a delay charge, utilizing among others the reliable and reproducible burning rates, low dependency of external conditions, variability in speed and ease of manufacture.

Delay charges are normally pressed higher than powder bulk density and preferably charge density corresponds to a press force above 10 MPa and more preferably above 100 MPa. The charge may have a density above 1 g/cc and preferably above 1.5 g/cc. For delay purposes the composition should not have too high reaction rates and preferably the charge burning speed is below 1 and more preferably below 0.3 m/sec. Generally the speed is higher than 0.001 and preferably higher than 0.005 m/sec. It is suitable that the charge amount is sufficiently large to give a delay time in said delay charge of more than 1 msec and preferably more than 5 msec.

Burning speed may be affected by any of the general methods defined, although a preferred way to increase speed is to use the gas-enhanced compositions as defined above and a preferred way to reduce speed is to add a filler, preferably an end product of the reaction and preferably the metal oxide. Aluminium oxides and silicon oxides have proven to be useful fillers independent of actual inversion system used. The filler amount can range from 10% by weight to 1000 % by weight but is preferably in the range of 20 to 100% by weight of the reactive components.

Another way of reducing speed of a delay charge is to select a semimetal as a fuel, especially silicon.

The delay charge can be pressed directly in the detonator shell against the subsequent charge of the pyrotechnical train, which solution is preferred for small charges and short delays. For larger charges the delay charge can be enclosed in an element placed within the shell in accordance with common practice. The delay composition column can be pressed in one operation but is often pressed in increments in case of longer columns. Typical charge lengths are between 1 and 100 mm and in particular between 2 and 50 mm.

In case of NPED type constructions an upstream secondary explosive is normally confined within a separate shell or element and here a third possibility is to position part of the whole delay charge within the same confinement.

The upstream end of the delay charge may be equipped with means for limiting backflow of gases and charge particles in order to improve further on burning rate stability, preferably a slag forming charge and most preferably a sealer charge, for instance having the composition described herein.

The other end of the delay charge may face any further charge of the Pyrotechnical chain, but may also be in contact with a primary or secondary charge, possibly via a small amount of another charge. Primary explosives can easily be detonated by the delay charge and secondary explosives ignited thereby, in the latter case preferably over a sealer or igniter charge as described herein.

The compositions described above can also be used in a charge which constitutes or is part of a sealing charge, retarding or preventing passage of gases after reaction of the charge. The sealing charge should also be mechanically strong. Reaction behavior in pyrotechnical charges is strongly dependent on gas pressure and reproducible burning is dependent on controlled build-up and maintenance of pressure. Even gas-less compositions exhibit a pressure rise and potential back-flow of gases due to gaseous intermediates or heating of gas present in charge pores. Coherence in pressed powder charges is also limited and pressure may cause interruptions.

Said sealing charges possess good slag-forming and sealing properties, which may be further improved by reinforcing additives. For these purposes it is beneficial to use fairly high charge densities. Preferably the charge density corresponds to a press force above 10 MPa and more preferably above 100 MPa. In absolute terms the pressed sealer charge can have a density above 1.5 g/cc and preferably above 2 g/cc. The charges tend to have intermediate burning speeds, preferably above 0.01 and more preferably above 0.1 m/sec but the speed is often below 1 m/sec.

When used purely for sealing purposes said charge is usually kept small and often sufficiently small to give a delay time in said sealing charge of less than 1 sec., and more often less than 100 msec.

When used as a sealing charge the composition generally contains inert fillers, inter alia to reduce permeability, e.g. as metal-reinforced compositions, as defined, with the same preferences as earlier given as the slags formed are both mechanically strong and highly gas impermeable. Here the stoichiometrical balance between metal and metal oxide reactants is less critical, as the filler tends to smooth out differences, and both over- and underbalanced compositions can be used as desired, for example to adjust burning rate. Generally, however, a stoichiometrical balance corresponding to the gas-enhanced compositions is preferred. The amount of filler can be varied within wide limits but as an indication the filler amount is between 20 and 80% by volume and preferably between 30 and 70% by volume.

In a detonator a sealing charge can be used whenever a sealing or reinforcing effect is desired. An important application is to seal off delay charges against backflow to thereby stabilize their burning properties. For this purpose the sealing charge should be located in the pyrotechnical train before the delay charge. Other pyrotechnical charges may be present between the sealing and delay charges but thanks to its good igniting performance the sealing charge can be positioned in direct contact with the delay charge. Any delay charge may be used, although delay charges as described herein are of special value. If the delay charge is housed in a special element or shell it is suitable but not necessary to press the sealer charge in the same structure.

An important embodiment of the invention is an NPED type detonator, i.e. where no primary but only secondary explosive is present. Here the new charge claimed also works as a sealing charge to seal off against pressure and backflow of gases. In such a detonator the secondary explosive is ignited for immediate transition into detonation. Here it is crucial with rapid ignition, small gas losses and maintained structural integrity of the area. For this purpose the ignition (and sealing) charge should be located immediately before or adjacent the secondary explosive. Said charge has good enough igniting properties to be used for the secondary explosive, although other charges, preferably charges as described herein, may be interposed therebetween. Normally the secondary explosive to be ignited is encased in a confinement. The ignition charge may then be positioned outside the confinement but at least some and preferably all of the charge is advantageously arranged within the confinement.

For a more general utility in detonators and for simplification of manufacture the charge may be pressed into an element of its own, suitably with a diameter adapted to the interior of the detonator shell.

Thus, the new charge according to the invention constitutes or is part of an ignition charge having the ability of igniting a secondary explosive into a burning or deflagrating state. The main use of such secondary explosive ignition is in NPED type detonators where lack of primary explosive makes it necessary to provide a mechanism for direct transition of secondary explosives into detonation.

NPED type detonators have been developed to avoid the safety problems inherent in all handling of the sensitive primary explosive in manufacture and use of detonators utilizing such explosives. Difficulties have arisen when trying to apply NPED principles to commercial detonators for rock blasting where special arrangements and transition mechanisms are needed.

Exploding wire or exploding film type igniting means, e.g. according to FR 2 242 899, are able to create a shock of sufficient magnitude to directly trigger detonation in secondary explosives if the igniting means are supplied with high momentary electric currents. They are not suited for commercial applications due to the advanced blasting machines needed and since they are incompatible with common protechnical delays.

Under suitable conditions secondary explosives are able to undergo a deflagration to detonation transition (DDT). The conditions normally require more heavy confinement and larger amounts of the explosive than can be accepted in commercial detonators. An example thereof is disclosed in U.S. Pat. No. 3,212,439.

Another NPED type, exemplified in U.S. Pat. Nos. 3,978,791, 4,144,814 and 4,239,004, uses initiated and deflagrating donor secondary explosive for acceleration of an impactor disc to hit a secondary explosive receptor charge with sufficient speed to cause a detonation of the receptor charge. To resist the forces involved these constructions are large, mechanically ungainly and not entirely reliable. A similar construction is disclosed in WO 90/07689.

The U.S. Pat. Nos. 4,727,808 and 5,385,098 describe another NPED type based on the DDT mechanism. The construction allows ignition with most of the conventional igniting means, can be manufactured by use of conventional detonator cap equipments, can be housed in normal detonator shells and can be reliably detonated with only slight confinement of the secondary explosive charge. Initiation reliability is, however, dependent on a certain design or division of the explosive where the transition is planned to take place.

General problems with known NPED designs are to obtain a fast enough transition into detonation to give both reliable ignition and satisfactory time precision and to achieve this in combination with common pyrotechnical charges. In NPED type detonators speed is of utmost importance in the secondary explosive sequences. Detonation must be established rapidly to avoid having the detonator structures destroyed prematurely by the expansion forces from the reacting explosive. Slow ignition also means broadened time scatter which is of importance for both momentary and delayed detonators. Rapid ignition is also believed to give a more smooth burning front, optimizing pressure build-up. These factors are crucial in all of the above-mentioned NPED types. In the DDT mechanism the transition zone has to be as short as possible and in the flying plate mechanism rapid combustion of the secondary explosive donor charge, plate shearing and acceleration have to take place before the donor charge chamber is blown apart.

The compositions disclosed herein have proven to be excellent ignition compositions for secondary explosives in the abovesaid applications, utilizing inter alia the hot and sustained ignition pulse from the charges containing the stated thermite redox-system to create a rapid and reliable initiation of the secondary explosives.

Although the compositions are generally suitable for said purpose some combinations are of special utility. The earlier described gas-enhanced compositions are advantageous, especially when the secondary explosive to be ignited has a certain porosity in the part to be ignited. In these cases preferably the density of the secondary explosive closest to the charge is between 40 and 90% and preferably between 50 and 80% of the secondary explosive crystal density. Suitable press forces can be between 0.1 and 50 and preferably between 1 and 10 MPa. Highly pressed secondary explosive is difficult to ignite but when ignited further reaction takes place rapidly. For such charges gas-rich ignition charges can be used but the compositions can be selected more freely. It is especially preferred to use filler-containing compositions for this purpose and in particular the metal-reinforced compositions. Although these compositions can be used to ignite secondary explosives of varying density, it is preferred to use them when the density of the secondary explosive closest to the charge is between 60 and 100% and preferably between 70 and 99% of the secondary explosive crystal density. Suitable press forces are above 10 and preferably above 50 MPa, in principle without any upper limit. It is preferred that the density of the ignition charge is somewhat adapted to the density of the secondary explosive to be ignited and preferably the ignition charge has a density, expressed as percentage of absolute, non-porous charge density, within the same intervals that have been given above for the low and high density charges respectively. Above given ranges are indicative only and have to be tested out for the actual construction and secondary explosive used.

The distinction between primary and secondary explosives is well known and widely used in the art. For practical purposes a primary explosive can be defined as an explosive substance able to develop full detonation when stimulated with a flame or conductive heating within a volume of a few cubic millimeters of the substance, even without any confinement thereof. A secondary explosive cannot be detonated under similar conditions. Generally a secondary explosive can be detonated when ignited by a flame or conductive heating only when present in much larger quantities or within heavy confinement such as a heavy walled metal container, or by being exposed to mechanical impact between two hard metal surfaces.

Examples of primary explosives are mercury fulminate, lead styphnate, lead azide and diazodinitrophenol or mixtures of two or more of these and/or other similar substances.

Representative examples of secondary explosives are pentaerythritoltetranitrate (PETN), cyclotrimethylenetrinitramine (RDX), cyclotetramethylenetetranitramine (HMX), trinitrophenylmethylnitramine (Tetryl) and trinitrotoluene (TNT) or mixtures of two or more of these and/or other similar substances. An alternative practical definition is to regard as secondary explosive any explosive equally or less sensitive then PETN.

For the present purposes any of the abovesaid secondary explosives can be used although it is preferred to select more easily ignited and detonated secondary explosives, in particular RDX and PETN or mixtures thereof.

Different initiating element parts may contain different secondary explosives. If the element is broadly divided into a deflagration section and a detonation section, with the proviso that the exact location of the transition point may vary and that the section division need not correspond to any physical structure of the element, it is preferred to use the more easily ignited and detonated explosives at least in the deflagration section while the explosive in the detonation section may be more freely selected.

The secondary explosive can be used in pure crystalline form, can be granulated and can contain additives. Crystalline explosive is preferred for higher press densities while granulated material is preferred for lower densities and porous charges. The present compositions are able to ignite secondary explosives without any additives although such may be used if desired, e.g. according to the abovesaid specification U.S. Pat. No. 5,385,098.

The secondary explosive is generally pressed to higher than bulk density, e.g. in increments for most homogeneous density in larger charges or in a one-step operation for smaller charges or in order to create a density gradient, preferably within each charge increasing density in the reaction direction suitably obtained by pressing in the reverse direction.

The present ignition mechanism does not require any physical division of the secondary explosive in a transition section and a detonation section but the charge can be allowed to directly initiate a conventional base charge without any confinement or any other confinement than a conventional detonator shell. It is preferred, however, that at least the transition section is given a certain confinement, for example by a radial confinement corresponding to a cylindrical steel shell between 0.5 and 2 mm, preferably between 0.75 and 1.5 mm, in thickness.

A suitable arrangement is to include both the pyrotechnical charge and the explosive in the transition section in a common element which is inserted in the detonator with the transition section facing the base charge. The element can be designed generally cylindrical.

Better confinement is obtained if the upstream end is provided with a constriction, preferably with a hole allowing each ignition. As an alternative or in addition thereto the end can be provided with a sealer charge, preferably of the current kind hereinabove described, which sealer charge can be placed upstream the confinement but is preferably placed within the confinement. From the considerations given it is evident that the present compositions can act both as sealer charges and ignition charges and in that case only one charge is needed. Otherwise the ignition charge is interposed between the sealer charge and the explosive.

The downstream end design is highly dependent on the detonation mechanism selected, which can be any one of the earlier described types and which are known and need not be described herein detail. A preferred NPED type is the one described in said U.S. Pat. No. 4,727,808 and U.S. Pat. No. 5,385,098, which are incorporated by reference herein.

Accordingly, in one embodiment the secondary explosive to be ignited is a donor charge for propelling an impactor disc through a channel towards a secondary explosive to be detonated thereby.

In another embodiment the secondary explosive to be ignited is the first part of a deflagration to detonation transition chain, said chain preferably further comprising a second part containing secondary explosive of lower density than in said first part. Common for all these detonation mechanisms is that in an early step a secondary explosive is ignited to a burning or deflagrating stage by use of mainly heat generating means, for which purpose the present compositions are excellently suited. The charge is positioned at the explosive to be ignited so that it is affected by the heat from the charge and preferably there is direct contact between charge and explosive. Above given conditions for the current charges relate to the part which is in this way used for ignition of the explosive.

The charge can be prepared by methods commonly used in the art. A preferred way involves mixing the ingredients of the charge, milling the mixture to the desired particle size in a mill providing more crushing than shearing action, compacting the so prepared mixture under high pressure into blocks, crushing the blocks to get particles consisting of smaller particles and finally performing a sieving operation to obtain the desired size fraction.

The detonator can be prepared by separate pressing of the base charge in the closed end of the detonator shell with subsequent pressing of the pyrotechnical charges according to the invention or insertion of the described elements or confinements at the base charge. A delay charge may be inserted together with an uppermost transfer charge if desired. Igniting means are positioned in the shell open end, which are sealed off by a plug with signalling means, such as shock tube or electrical conductors, penetrating the plug.

EXAMPLE 1

An ignition charge of Al—$Fe_2O_3$ with twice the amount of Al relative to stoichiometrical proportions was pressed in a steel tube having an outside diameter of 6,3 mm and a wall thickness of 0,8 mm. One end of said tube was open and the other one contained a diaphragm having a hole with a diameter of 1 mm. The ignition charge was pressed into said diaphragm. Then a 4 mm column of PETN was pressed into the same and finally an aluminium cup was pressed in. Such elements were manufactured in a number of 100. The elements were then pressed in standard aluminium shells containing second parts of secondary explosives of an NPED system.

Test shootings showed that all detonators functioned in an excellent way and the operation time including deflagration of the Nonel tube (3,6 m) was not more than 4 ms.

Then 100 detonators of the same design but with a stoichiometric pyrotechnical composition were manufactured. At the test shooting there were two misfires where PETN was not ignited. There was an increase of detonator operation time up to 8–10 ms.

EXAMPLE 2

Steel tubes having an outside diameter of 6,3 mm and a wall thickness of 0,5 mm and a length of 10 mm were used. One end of said tubes was open and in the other end there was a diaphragm with a hole having a diameter of 1 mm.

Pyrotechnical charges for use as ignition charges were pressed into said diaphragm, and then PETN explosives were pressed in.

Three types of slag-less inversion compositions were used, viz 40% of Al+60% of $Fe_2O_3$; 20% of Al+80% of $Bi_2O_3$; and 30% of Al+70% of $Cu_2O$, all percentages being weight percentages, the results of the experiments were that all of the charges shows approximately the same ability to ignite secondary PETN explosives. Generally it can be said that the best ignition is obtained at a PETN density of 1,3 $g/m^3$ and that the limit were ignition is impaired is at a density of about 1,5 $g/m^3$.

EXAMPLE 3

Into 20 initiating elements in the form of aluminium tubes, each having a length of 20 mm and an internal diameter of 3 mm and an outside diameter of 6 mm, an ignition charge consisting of 20% by weight of Ti+80% by weight of $Bi_2O_3$ was pressed to a column height of 5 mm. Adjacent thereto a column of PETN with a density of 1.3 $g/cm^3$ was pressed.

In the same way 20 initiating elements were manufactured with the exception that the ignition charge (i.e. 20% of Ti+80% of $Bi_2O_3$) also contained 8% by weight of $Fe_2O_3$ as an additive.

This experiment showed that all 40 detonators containing said initiating elements worked excellently with a qualitative detonation of the base charge.

EXAMPLE 4

The influence of the additive $Fe_2O_3$ on an ignition-charge consisting of 20% by weight of Ti+80% by weight of $Bi_2O_3$ concerning the sensitivity to electrostatic sparks was examined in accordance with standard testing methods.

The sensitivity of the mere charge of 20% of Ti+80% of $Bi_2O_3$ was –0.5 mJ.

The addition of 2–10% by weight of $Fe_2O_3$ to said charge reduced the sensitivity of the charge to a considerable extent (–2–5 mJ) and has an insignificant influence on the operability of the ignition charge.

What is claimed is:

1. A detonator comprising a shell with a base charge comprising secondary explosive at one end thereof, igniting means arranged at the opposite end thereof and an intermediate pyrotechnical train converting an ignition pulse from the igniting means to the base charge to detonate the same, the pyrotechnical train comprising an ignition charge comprising a metal fuel selected from Be, Mg, Ca, Sr, Ba, Ti, Hf, Al, Ga, In and Tl and an oxidant in the form of an oxide of a metal selected from periods 4 and 6 of the periodic table, the metal fuel being present in an excess relative to the amount stoichiometrically necessary to reduce the amount of metal oxide oxidant, said ignition charge generating a hot pressurized gas that is able to ignite said secondary explosive of the base charge into a convective deflagrating state to reliably detonate the same.

2. A detonator according to claim 1, wherein the metal fuel is at least 0.5, preferably at least 0.75 and more preferably at least 1 volt more elektronegative than the metal of the metal oxide oxidant.

3. A detonator according to claim 1, wherein the metal fuel has been selected from periods 3 and 4 of the Periodic Table.

4. A detonator according to claim 1, wherein the metal fuel has been selected from Al and Ti.

5. A detonator according to claim 1, wherein the metal oxide oxidant comprises a metal selected from Cr, Mn, Fe, Ni, Cu, Zn, Ba, W and Bi.

6. A detonator according to claim 5, wherein said metal is selected from Mn, Fe, Cu and Bi.

7. A detonator according to claim 6, wherein said metal oxide is selected from $MnO_2$, $Fe_2O_3$, $Fe_3O_4$, $Cu_2O$, CuO and $Bi_2O_3$.

8. A detonator according to claim 6, wherein said metal fuel-metal oxide oxidant combination comprises Al in combination with an oxide of Fe, Bi or Cu.

9. A detonator according to claim 8, wherein said combination is Al—$Fe_2O_3$, Al—$Bi_2O_3$ or Al—$Cu_2O$, preferably Al—$Fe_2O_3$.

10. A detonator according to claim 6, wherein said metal fuel-metal oxide oxidant combination comprises Ti in combination with an oxide of Bi, preferably Ti—$Bi_2O_3$.

11. A detonator according to claim 1, wherein the amount of metal fuel is more than 1 and less than 12, preferably less than 6, more preferably less than 4, the amount of stoichiometrically necessary to reduce the amount of metal oxide oxidant.

12. A detonator according to claim 11, wherein the amount of metal fuel is between 1.1 and 6 times said stoichiometrically necessary amount.

13. A detonator according to claim 12, wherein the amount of metal fuel is between 1.5 and 4 times said stoichiometrically necessary amount.

14. A detonator according to claim 1, wherein the percentage of metal fuel is 10–50% by weight, preferably 15–35% by weight, more preferably 15–25% by weight, and the percentage of metal oxide oxidant is 90–50% by weight, preferably 85–65% by weight, more preferably 75–65% by weight, said percentages being based on the ignition charge composition.

15. A detonator according to claim 14, wherein the metal fuel is Al and the metal oxide oxidant is $Cu_2O$ or $Bi_2O_3$, the percentage of said fuel being 15–35% by weight and the percentage of said oxidant being 65–85% by weight.

16. A detonator according to claim 14, wherein the metal fuel is Ti and the metal oxide oxidant is $Bi_2O_3$, the percentage of said fuel being 15–25% by weight, preferably around 20% by weight, and the percentage of said oxidant being 75–85% by weight, preferably around 80% by weight.

17. A detonator according to claim 1, wherein said ignition charge has such a composition that the burning speed thereof is between 0.001 and 50 m/sec, preferably between 0.005 and 10 m/sec.

18. A detonator according to claim 1, wherein said ignition charge contains a solid component additive in the form of a metal and/or an oxide.

19. A detonator according to claim 18, wherein said additive is present in an amount of 2–30% by weight, preferably 4–20% by weight, more preferably 5–15% by weight, such as 6–10% by weight, based on the weight of said ignition charge.

20. A detonator according to claim 18, wherein said additive is a compound which is also a product of the reaction between metal fuel and metal oxide oxidant.

21. A detonator according to claim 18, wherein said additive is a particulate metal.

22. A detonator according to claim 21, wherein said metal is solid at the reaction temperature of the ignition charge.

23. A detonator according to claim 18, wherein said oxide is selected from oxides of Al, Si, Zn, Fe, Ti and mixtures thereof.

24. A detonator according to claim 23, wherein said oxide is an aluminium oxide, a silicon oxide or a mixture thereof.

25. A detonator according to claim 23, wherein said oxide is an iron oxide, especially $Fe_2O_3$.

26. A detonator according to claim 18, wherein said metal is selected from W, Ti, Ni and mixtures and alloys thereof.

27. A detonator according to claim 26, wherein said metal is W or a mixture or alloy of W with Fe.

28. A detonator according to claim 1, wherein said ignition charge has been pressed and placed in contact with said secondary explosive.

29. A detonator according to claim 28, wherein said charge has been placed in contact with the secondary explosive in a transition section, located in the pyrotechnical train before the base charge, where the secondary explosive is surrounded by a confinement.

30. A detonator according to claim 29, wherein also said charge has been positioned in the confinement.

31. A detonator according to claim 28, wherein the density of the secondary explosive closest to said charge is between 60 and 100% and preferably between 70 and 99% of the secondary explosive crystal density.

32. A detonator according to claim 31, wherein the density of the secondary explosive closest to said charge is between 40 and 90% and preferably between 50 and 80% of the secondary explosive crystal density.

33. A detonator according to claim 29, characterized in that the secondary explosive in the transition charge is the first part of a deflagration to detonation transition chain, said chain preferably further comprising a second part containing another secondary explosive of lower density than in said first part.

34. A detonator according to claim 1, wherein said base charge is secondary explosive only.

35. A detonator according to claim 1, wherein said secondary explosive is selected from pentaerythritoltetranitrate (PETN), trinitrophenylmethylnitramine (Tetryl) and trinitrotoluene (TNT) and preferably is PETN.

36. A detonator according to claim 2, wherein the metal fuel has been selected from periods 3 and 4 of the Periodic Table.

37. A detonator according to claim 19, wherein said additive is a compound which is also a product of the reaction between metal fuel and metal oxide oxidant.

38. A detonator according to claim 19, wherein said additive is a particulate metal.

39. A detonator according to claim 5, wherein said metal is W.

* * * * *